United States Patent [19]

Mikawa et al.

[11] 4,340,663

[45] Jul. 20, 1982

[54] PHOTOGRAPHIC FILM

[75] Inventors: Akikazu Mikawa, Minami-ashigara; Kyoichi Naruo, Fujinomiya, both of Japan

[73] Assignee: Fuji Photo Film Co., Ltd., Kanagawa, Japan

[21] Appl. No.: 259,648

[22] Filed: May 1, 1981

[30] Foreign Application Priority Data

May 14, 1980 [JP] Japan ..... 55-65750[U]

[51] Int. Cl.[3] ..... G03C 3/02; G03C 1/76

[52] U.S. Cl. ..... 430/496; 430/501; 352/241

[58] Field of Search ..... 430/495, 496, 500, 501, 430/934, 140; 352/241

[56] References Cited

U.S. PATENT DOCUMENTS

| | | | |
|---|---|---|---|
| 1,205,822 | 11/1916 | Trivelli | 430/934 |
| 1,450,795 | 4/1923 | Dohe | 352/241 |
| 1,602,599 | 10/1926 | Van Derhoet | 430/496 |
| 3,379,605 | 4/1968 | Nerwin | 430/934 |

FOREIGN PATENT DOCUMENTS

| | | | |
|---|---|---|---|
| 557695 | 2/1932 | Fed. Rep. of Germany | 352/241 |
| 562375 | 11/1923 | France | 352/241 |

OTHER PUBLICATIONS

Glatkides, Photographic Chemistry, vol. 1, 1958, pp. 441–467.

*Primary Examiner*—Mary F. Downey

*Attorney, Agent, or Firm*—Sughrue, Mion, Zinn, Macpeak & Seas

[57] ABSTRACT

A photographic film, particularly a 35-mm film, which can tear only in a direction opposite from the picture regions of the film. Cuts, such as a V-shaped notch or a linear cut, are formed in the film extending from each perforation in a direction opposite to the picture region of the film. If a high force is applied to the perforations of the film while the film is being conveyed, the film will tear only at the notch thus absorbing the force and preventing damage to the film conveying mechanism.

6 Claims, 2 Drawing Figures

PHOTOGRAPHIC FILM

BACKGROUND OF THE INVENTION

The present invention relates to an improved 35-mm photographic film.

35-mm photographic film in Japan is regulated in configuration by Japanese Industrial Standard K7519-1964, corresponding to U.S. American National Standard ANSI PH 1.14-1976. Also, the configuration of perforations which are formed along the sides thereof in the longitudinal direction is set forth in Japanese Industrial Standard K7552-1965, corresponding to ANSI PH 22.93-1980 and PH 22.139-1980. However, the types and properties of the film support are not regulated. Therefore, film manufacturers have provided various photographing films having different film supports. Most of these photographing films have a triacetate cellulose (TAC) base. However, TAC base 35-mm photographing film suffers from the following difficulties in handling or processing:

(i) In winding or rewinding the film in a camera, the perforations of the film may be broken by the film feeding pawl wherein film portions between the perforations may be torn out. If this occurs, the photographing operation must be stopped.

(ii) Film having such torn-out portions may be wound in the camera. However, when the film is conveyed by a roller conveyor type automatic developing machine to be processed in a developing laboratory, the film may tear in the widthwise direction thereof in the area of a torn-out portion. If this occurs, the film processing operation must be halted and the film rejoined.

(iii) In order to avoid the above-described difficulties, photographic film to be processed is inspected to determine whether or not it has any torn-out portions, for instance, in a developing laboratory. If such is detected, these portions must be reinforced with an adhesive tape or the like prior to processing.

The reason why a conventional 35-mm photographic film suffers readily from this problem is that the TAC base has a low tearing strength.

In order to eliminate the above-described difficulties accompanying conventional photographic film, a film has been proposed in which a polyethyleneterephthalate (PET) base, which has as high tearing strength, is used as the film base. Merely by employing the PET base, the formation of the torn-out portions can be prevented. However, this film is disadvantageous in that a high force exerted on the film base will then act strongly on the film conveying unit in the camera or in the film processing machine, possibly resulting in damage thereto.

Accordingly, an object of the invention is to provide a 35-mm photographic film in which all of the above-described difficulties accompanying conventional 35-mm photographic film have been eliminated so that, in handling and processing the film, the film can be smoothly conveyed.

SUMMARY OF THE INVENTION

The foregoing object and other objects of the invention have been achieved by the provision of a photographic film, such as 35-mm film, in which a cut, such as a V-shaped notch or linear cut, is formed in a part of the edge of each of the perforations provided along the edge of the film in the longitudinal direction so that the film will tear from the notch only in a direction opposite to the direction of the picture region of the film.

If an abnormally high force is applied to a perforation of the film according to the invention while the film is being conveyed, the film will tear at the notch thus absorbing the high force. In this manner, the formation of torn-out portions in the film is minimized and the film conveying mechanism is protected from damage. This will become more apparent from the following detailed description of a preferred embodiment of a 35-mm photographic film according to the invention.

DESCRIPTION OF THE PREFERRED EMBODIMENTS

Figure 1:
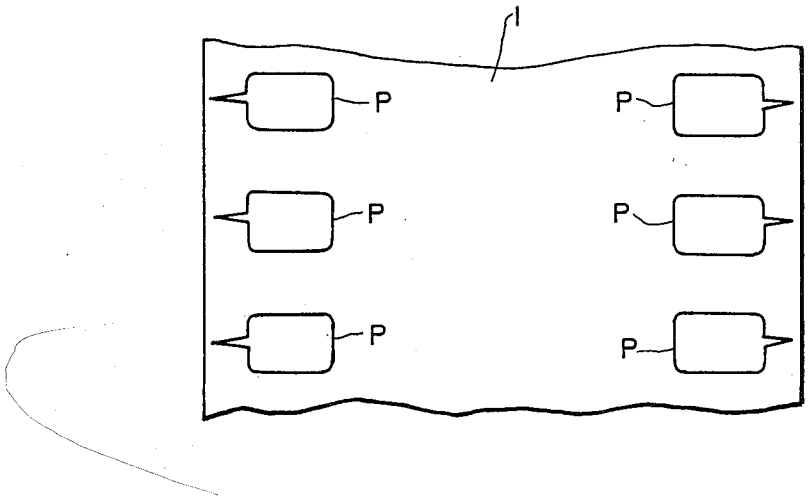
FIG. 1 is a plan view showing a first preferred embodiment of 35-mm photographic film according to the invention.

FIG. 1 is a plan view showing a first preferred embodiment of a 35-mm photographic film according to the invention. In FIG. 1, reference character P designates perforations (sprocket holes) which are formed in the film 1 successively at equal intervals in the longitudinal direction of the film and reference numeral 2 designates notches one of which is cut in the edge of each perforation P at a position opposite to the picture region of the film. It is preferable that the base of the film 1 be a PET base due to the following reason. For PET base and TAC base films of equal thickness, in general the PET base film has about three or four times the tearing strength and is lower in manufacturing cost than the TAC base film.

The notches 2 may be cut in the film simultaneously when the perforations P are cut with a punch or the like or by cutting them with a notcher or the like separately from the cutting of the perforations.

The position of each notch 2 is in a part of the edge of the respective perforation which is opposite to the picture region of the film. The configuration of the notch 2 should be such that when an extraordinarily high force is exerted on the perforation, the film 1 will tear outwardly in a direction away from the picture region of the film.

With the photographic film as described above, if in winding or rewinding the film in a camera, for instance, the film snags in the camera and a considerably high force is exerted on a perforation P by a film feeding pawl, the film 1 will readily tear from the notch 2 of the perforation outwardly away from the picture region of the film. Thus, the picture region of the film is protected from tearing; that is, the film is protected from being torn in the widthwise direction. In addition, a problem that a film conveying unit such as the above-described film feeding pawl can be broken is eliminated with the use of the film of the invention.

Figure 2:
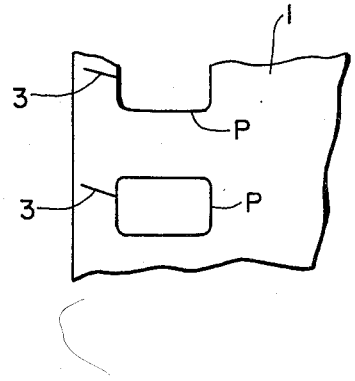
FIG. 2 is a plan view showing a second preferred embodiment of 35-mm photographic film according to the invention.

While a first preferred embodiment of 35-mm photographic film has been described, it should be noted that the present invention is not limited thereto or thereby. That is, the 35-mm photographic film described above can be modified as follows:

The notch in the film of the invention is not limited to the V-shaped shown in FIG. 1. It may be a linear cut 3 as shown in FIG. 2. That is, all that is required for the notches is that the notches be so designed that when an abnormally high force is applied to a perforation in the film, the film will tear outwardly from the perforation. Thus, the notches may have any configuration and may be provided at any positions if the above-described requirement is satisfied.

The objects of the invention can be achieved by providing the perforation with an elliptical or rhombic shape or by decreasing the distance between the perforation edge and the film edge, for instance. However, these techniques are presently not preferred because they conflict with the above-described Japanese Industrial Standards.

As is apparent from the above description, the invention provides significant advantages in that in handling film or in processing film, the formation of torn-out portions between the perforations is minimized and breakage of the film from the torn-out portions is prevented. Thus, damage to the film conveying unit of a camera or an automatic developing machine is prevented.

What is claimed is:

1. Photographic film of the type having perforations formed along at least one edge of said film in the longitudinal direction of said film at predetermined intervals, the improvement comprising a cut being formed extending from each of said perforations on the side of said perforations away from a picture region toward the marginal edges of said film wherein tears at said perforations propagate away from said film picture regions.

2. The photographic film of claim 1 wherein said perforations are formed along both longitudinal edges of said film.

3. The photographic film of claim 1 wherein each said cut is a V-shaped notch.

4. The photographic film of claim 1 wherein each said cut comprises a linear cut.

5. The photographic film of claim 1 wherein each said cut comprises a linear cut fomed at an acute angle with respect to the widthwise direction of said film.

6. The photographic film as claimed in any of claims 1–5 wherein said film comprises a base of polyethyleneterephthalate.

* * * * *